US010941015B1

(12) United States Patent
Matari et al.

(10) Patent No.: US 10,941,015 B1
(45) Date of Patent: Mar. 9, 2021

(54) REEL SYSTEM AND METHOD

(71) Applicant: Trinity Bay Equipment Holdings, LLC, Houston, TX (US)

(72) Inventors: Nader N. Matari, Houston, TX (US); Alexander Lee Winn, Spring, TX (US)

(73) Assignee: Trinity Bay Equipment Holdings, LLC, Houston, TX (US)

( * ) Notice: Subject to any disclaimer, the term of this patent is extended or adjusted under 35 U.S.C. 154(b) by 0 days.

(21) Appl. No.: 16/736,666

(22) Filed: Jan. 7, 2020

(51) Int. Cl.
*B65H 75/24* (2006.01)
*B65H 75/14* (2006.01)
*B65H 75/22* (2006.01)

(52) U.S. Cl.
CPC ..... *B65H 75/241* (2013.01); *B65H 75/14* (2013.01); *B65H 75/22* (2013.01); *B65H 2402/40* (2013.01); *B65H 2701/33* (2013.01)

(58) Field of Classification Search
CPC ..... B65H 75/14; B65H 75/22; B65H 75/241; B65H 2701/33
See application file for complete search history.

(56) References Cited

U.S. PATENT DOCUMENTS

2015/0122929 A1* 5/2015 Garton ..... B65H 75/14 242/118.5

FOREIGN PATENT DOCUMENTS

WO WO-2013157163 A1 * 10/2013 ..... B65H 75/241

OTHER PUBLICATIONS

Machine Translation of WO 2013/157163 A1, Oct. 24, 2013. (Year: 2013).*

* cited by examiner

*Primary Examiner* — William E Dondero
(74) *Attorney, Agent, or Firm* — Fletcher Yoder, P.C.; Matthew G. Osterhaus

(57) ABSTRACT

A reel system that includes a drum that receives a coil of flexible pipe. A first flange that removably couples to a first side of the drum. A second flange that removably couples to a second side of the drum. The first flange and the second flange secure the coil of flexible pipe to the drum.

20 Claims, 12 Drawing Sheets

REEL SYSTEM AND METHOD

BACKGROUND

This section is intended to introduce the reader to various aspects of art that may be related to various aspects of the present disclosure, which are described below. This discussion is believed to be helpful in providing the reader with background information to facilitate a better understanding of the various aspects of the present disclosure. Accordingly, it should be understood that these statements are to be read in this light, and not as admissions of prior art.

Flexible pipe is useful in various environments, including in the oil and gas industry. Flexible pipe may be durable and operational in harsh operating conditions and can accommodate high pressures and temperatures. As the flexible pipe is manufactured, the flexible pipe may be wound onto a reel or spool. The reel may therefore facilitate storage, transportation, and eventual deployment of the flexible pipe. After deployment, the reel may be returned to the manufacturing plant where additional flexible pipe is wound onto the reel. Reel production, reel shipment to and from a deployment site, and the use of reels to store flexible pipe can be very expensive or logistically challenging.

SUMMARY

This summary is provided to introduce a selection of concepts that are further described below in the detailed description. This summary is not intended to identify key or essential features of the claimed subject matter, nor is it intended to be used as an aid in limiting the scope of the claimed subject matter.

In one example, a reel system that includes a drum that receives a coil of flexible pipe. A first flange that removably couples to a first side of the drum. A second flange that removably couples to a second side of the drum. The first flange and the second flange secure the coil of flexible pipe to the drum.

In another example, a system that includes a reel system. The reel system includes a first flange that removably couples to a first side of a drum. A second flange removably couples to a second side of the drum. The first and second flanges secure the coil of flexible pipe to the drum. A flange adjustment system that includes a first connector that couples to the first flange. A ratchet that couples to the first connector with a chain or strap. The ratchet reduces a length of the chain or the strap between the first connector and the ratchet to reduce a distance between the first flange and the second flange.

In another example, a reel system that includes a drum configured to receive a coil of a flexible pipe, a first flange, and a second flange. A drum modification system that includes a first shell that couples to the drum. The first shell increases a diameter of the drum.

Other aspects and advantages of the claimed subject matter will be apparent from the following description and the appended claims.

DETAILED DESCRIPTION

Figure 1:
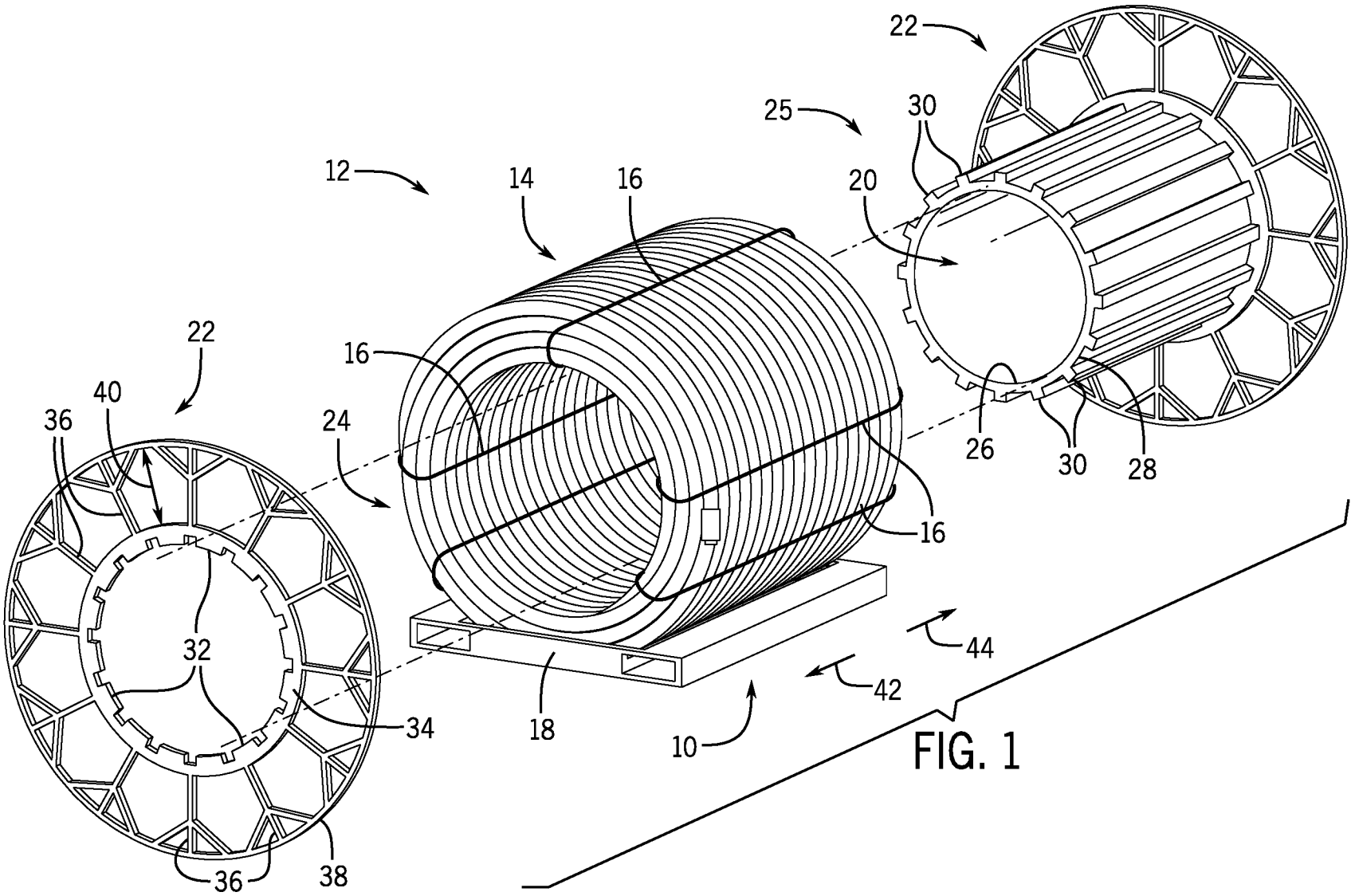
FIG. 1 is a perspective view of a reel system coupling to a coil of flexible pipe, according to embodiments of the present disclosure.

Certain embodiments commensurate in scope with the present disclosure are summarized below. These embodiments are not intended to limit the scope of the disclosure, but rather these embodiments are intended only to provide a brief summary of certain disclosed embodiments. Indeed, the present disclosure may encompass a variety of forms that may be similar to or different from the embodiments set forth below.

As used herein, the term "coupled" or "coupled to" may indicate establishing either a direct or indirect connection, and is not limited to either unless expressly referenced as such. The term "set" may refer to one or more items. Wherever possible, like or identical reference numerals are used in the figures to identify common or the same elements. The figures are not necessarily to scale and certain features and certain views of the figures may be shown exaggerated in scale for purposes of clarification.

Furthermore, when introducing elements of various embodiments of the present disclosure, the articles "a," "an," and "the" are intended to mean that there are one or more of the elements. The terms "comprising," "including," and "having" are intended to be inclusive and mean that there may be additional elements other than the listed elements. Additionally, it should be understood that references to "one embodiment" or "an embodiment" of the present disclosure are not intended to be interpreted as excluding the existence of additional embodiments that also incorporate the recited features. Furthermore, the phrase A "based on" B is intended to mean that A is at least partially based on B. Moreover, unless expressly stated otherwise, the term "or" is intended to be inclusive (e.g., logical OR) and not exclusive (e.g., logical XOR). In other words, the phrase A "or" B is intended to mean A, B, or both A and B.

As explained above, reels or spools increase the cost and complexity of manufacturing, shipping, and deploying flexible pipe. To reduce the number of reels used for shipping, storage, and deployment of flexible pipe, the disclosure describes various systems that enable storage and shipment of flexible pipe as a coil without a reel or spool. These systems include a reel system (e.g., modular reel system)

that can be assembled and coupled to a coil of flexible pipe. For example, flexible pipe may be shipped as a coil to a deployment site. At the deployment site the reel system is assembled and coupled to the coil of flexible pipe enabling the flexible pipe to be controllably unwound and deployed. Also described in this disclosure is a modular flange system, a flange adjustment system, and a drum modification system.

The modular flange system enables formation of a flange out of multiple pieces. The modular flange system enables formation of a flange prior to coupling to a drum or assembly of the flange around the drum. For example, the modular flange system enables assembly of a flange around a drum in situations where an object (e.g., forklift) may obstruct attachment of a fully formed flange to the drum (e.g., obstruct the ability to slide a flange over a drum).

The flange adjustment system enables spacing adjustment between flanges coupled to a drum. In operation, the flange adjustment system may adjust spacing between flanges to accommodate different coil sizes of flexible pipe. The flange adjustment system may also block or reduce lateral shifting of flexible pipe on the drum during deployment.

The drum modification system enables adjustment of a drum's outermost diameter to accommodate different coil sizes. Coils of flexible pipe may vary in their innermost diameters depending on the size of the flexible pipe. For example, small diameter flexible pipe may be bound into tight bundles of coil (e.g., small innermost diameters) without kinking the flexible pipe. In contrast, large diameter flexible pipe may not be bound into tight coils without kinking. The drum modification system enables drum diameter adjustment by adding or removing shells that change the drum's outer diameter. In this way, the drum modification system enables a drum to be modified for different coils of flexible pipe.

FIG. 1 is a perspective view of a coil of flexible pipe 10 and a reel system 12. During the manufacturing process, the flexible pipe 10 is wound into a coil 14. The flexible pipe 10 may be bound into the coil 14 using bands 16 and placed on a pallet 18 to facilitate shipment to a deployment site without the reel system 12. Shipment of the coil 14 to the deployment site without a reel may reduce shipment costs and increase the space available for shipping.

Flexible pipe 10 is a tube that conveys or transfers any water, gas, oil, or any type of suitable fluid. The flexible pipe 10 may be made of any type of materials including plastics, metals, composites (e.g., fiber-reinforced composites), and/or other suitable materials. The flexible pipe 10 may include Bonded or Unbonded Flexible Pipe, Flexible Composite Pipe (FCP), Thermoplastic Composite Pipe (TCP) or Reinforced Thermoplastic Pipe (RTP). FCP or RTP pipe may itself be generally composed of several layers. In one or more embodiments, a flexible pipe may include a thermoplastic liner or internal pressure sheath having a reinforcement layer and a thermoplastic outer cover layer. In one or more embodiments, the thermoplastic may be high density polyethylene (HDPE). Thus, flexible pipe may include different layers that may be made of a variety of materials and may also provide corrosion resistance. For example, in one or more embodiments, pipe used to make up a coil of pipe may have a corrosion protection outer cover layer that is disposed over another layer of steel reinforcement. In this embodiment, helically wound steel strips may be placed over a liner made of thermoplastic pipe. Flexible pipe may be designed to handle a variety of pressures. Accordingly, flexible pipe may offer unique features and benefits versus steel/carbon steel pipe lines in the area of corrosion resistance, flexibility, installation speed and re-usability. Another type of flexible or spoolable pipe is coiled tubing or reeled tubing, which may be made of steel and have corrosion protection shield layer.

After arriving at the deployment site or a staging site, the coil 14 may be prepared for deployment using the reel system 12. The reel system 12 is a modular system that includes a drum 20 and flanges 22 that couple together to form a reel or spool from which the flexible pipe 10 may be deployed. The reel system 12 forms the reel or spool with the coil 14 by inserting the drum 20 into the aperture 24 formed by coil 14. The flanges 22 are then coupled (i.e., removably coupled) to the drum 20 to retain the coil 14 on the drum 20. For example, the flanges 22 may couple to the drum 20 with a friction fit and/or fasteners (e.g., bolts, pins).

The drum 20 and the flanges 22 couple together using an interlocking connection 25 (e.g., teeth). In some embodiments, the teeth of the interlocking connection 25 may have different cross-sections (e.g., square, rectangular, ovular, semi-circular). As illustrated, the drum 20 includes a cylinder 26. Coupled to an outer or exterior surface 28 of the cylinder 26 are bars 30. The bars 30 may extend along the entire length of the cylinder 26 or along a portion (e.g., 1-24 inches from the respective ends of the drum 20). The bars 30 may also be equally spaced and/or unequally spaced about the circumference of the cylinder 26. For example, some of the bars 30 may be equally spaced about a portion of the circumference while other bars 30 are unequally spaced about another portion of the cylinder 26. In operation, the bars 30 form a pattern that interlocks with corresponding teeth 32 (e.g., protrusions) on the flanges 22. The bars 30 may also provide supporting strength to the cylinder 26 enabling the drum 20 to support the weight of the coil 14.

In order for the flanges 22 to couple to the cylinder 26, the flanges 22 include teeth 32 that interface (e.g., interlock) with the bars 30 on the drum 20. It should be understood, that the pattern of the teeth 32 matches the pattern of the bars 30 on the drum to enable the flanges 22 to slide over the exterior surface 28 of cylinder 26. The teeth 32 on the flanges 22 extend radially inward from an interior cylinder 34. Coupled to the interior cylinder 34 are spokes or bars 36 that couple the interior cylinder 34 to an outer cylinder 38. The distance 40 between the interior cylinder 34 and the outer cylinder 38 enables the flanges 22 to contact and block lateral movement of the flexible pipe 10 in directions 42 and 44.

Figure 2:
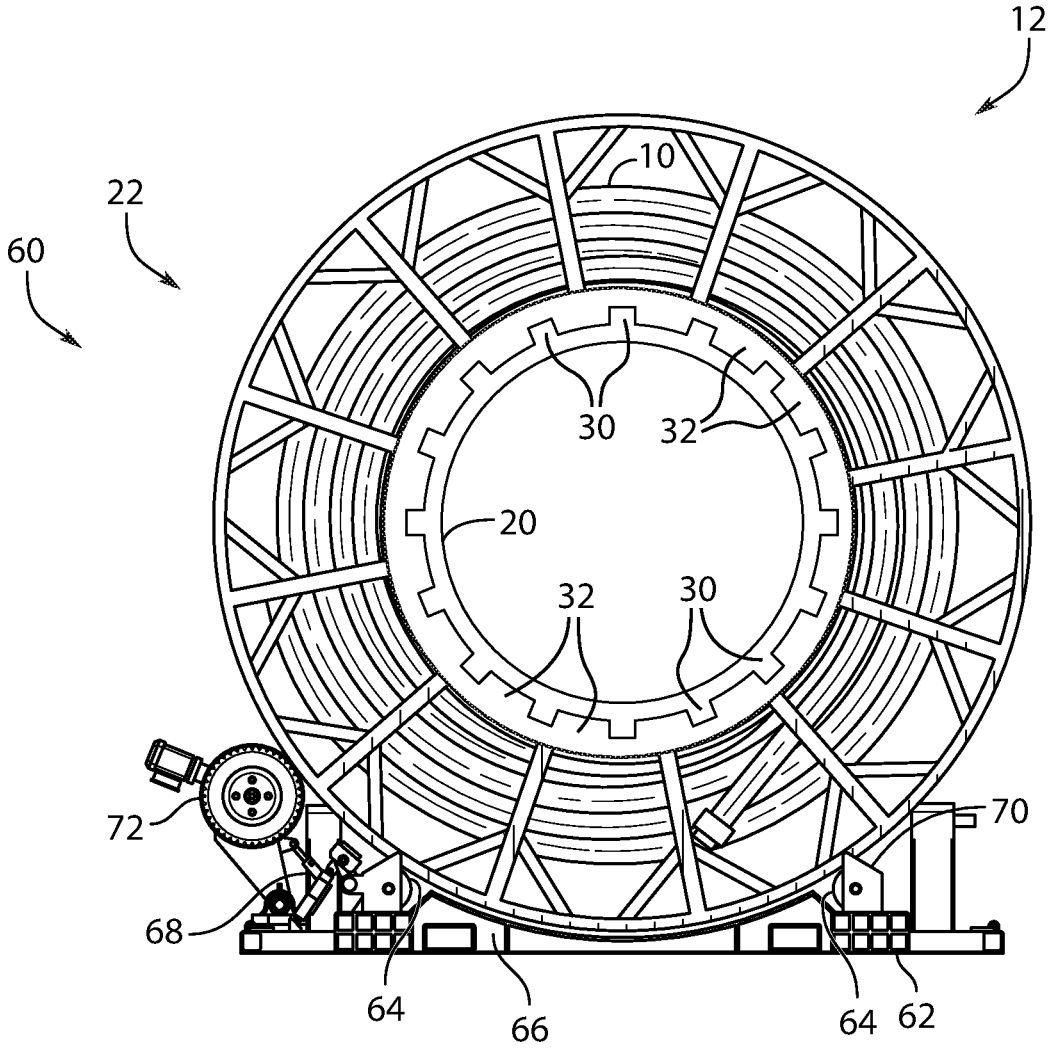
FIG. 2 is a side view of a pipe reel cradle, according to embodiments of the present disclosure.

FIG. 2 is a side view of a pipe reel cradle 60 with the coil 14 and the reel system 12 supporting the coil 14 on the pipe reel cradle 60. After assembling the reel system 12, the reel system 12 and coil 14 may be placed on the pipe reel cradle 60 for deployment of the flexible pipe 10. In operation, the pipe reel cradle 60 facilitates rotation of the reel system 12 and therefore the unwinding of the flexible pipe 10. It should be understood though that in some embodiments, the flexible pipe 10 may be pulled off of the reel system 12 by an external machine.

The pipe reel cradle 60 of FIG. 2 includes a frame 62 that provides a base for supporting components of the pipe reel cradle 60. The frame 62 supports rollers 64 that couple to the frame 62. The rollers 64 may be coupled to the frame 62 and are used to support the reel system 12, which in turn supports the coil 14. In operation, the rollers 64 rotate which drives rotation of the flanges 22. Rotation of the flanges 22 in turn rotates the drum 20 unspooling the flexible pipe 10. Cradles 66 may also couple to the frame 62 between the rollers 64. In addition, one or more pipe guides 68 may be coupled to the frame 62 and used to guide the flexible pipe 10 during deployment from the reel system 12. A pipe brake 70 may be coupled to the frame 62 and used to slow or stop rotation of the reel system 12. Finally, a pipe re-spooler 72 may be coupled to the frame 62 and used to re-spool portions of flexible pipe 10 back onto the reel system 12.

Figure 3:
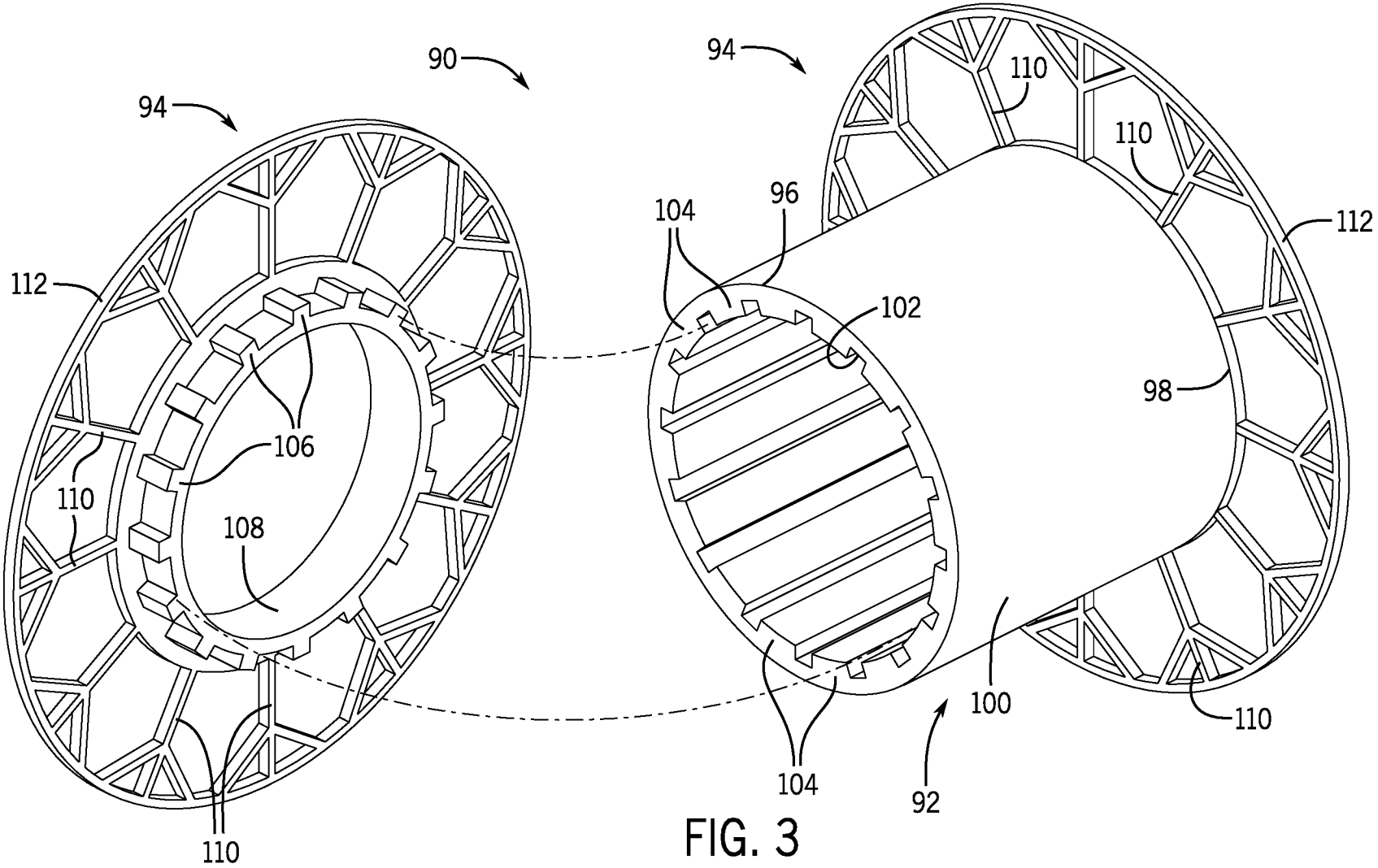
FIG. 3 is a perspective view of a reel system, according to embodiments of the present disclosure.

FIG. 3 is a perspective view of a reel system 90 that includes a drum 92 and flanges 94. The reel system 90 is assembled by coupling flanges 94 to opposing ends 96, 98 of the drum 92 to form a reel or spool from which the flexible pipe 10 may be deployed. The drum 92 and the flanges 94 couple together using interlocking teeth. As illustrated, the drum 92 includes a cylinder 100. Bars 104 couple to an interior surface 102 of the cylinder 100. The bars 104 may be equally spaced and/or unequally spaced about the interior circumference of the cylinder 100. For example, some of the bars 104 may be equally spaced about a portion of the interior circumference while other bars 104 are unequally spaced about another portion of the cylinder 100. In operation, the bars 104 form a pattern that interlocks with corresponding teeth 106 (e.g., protrusions) on the flanges 94. The bars 104 may also provide supporting strength to the cylinder 100 enabling the drum 92 to support the weight of the coil 14.

In order for the flanges 94 to couple to the cylinder 100, the flanges 94 include teeth 106 that interface (e.g., interlock) with the bars 104 on the drum 92. It should be understood, that the pattern of the teeth 106 matches the pattern of the bars 30 on the drum 92 to enable coupling. The teeth 106 on the flanges 94 extend radially inward and outward from an interior cylinder 108, which enables the teeth 106 to be inserted into the drum 92. Coupled to the interior cylinders 108 are spokes or bars 110 that couple the interior cylinder 108 and to an outer cylinder 112 to form the flanges 94.

Figure 4:
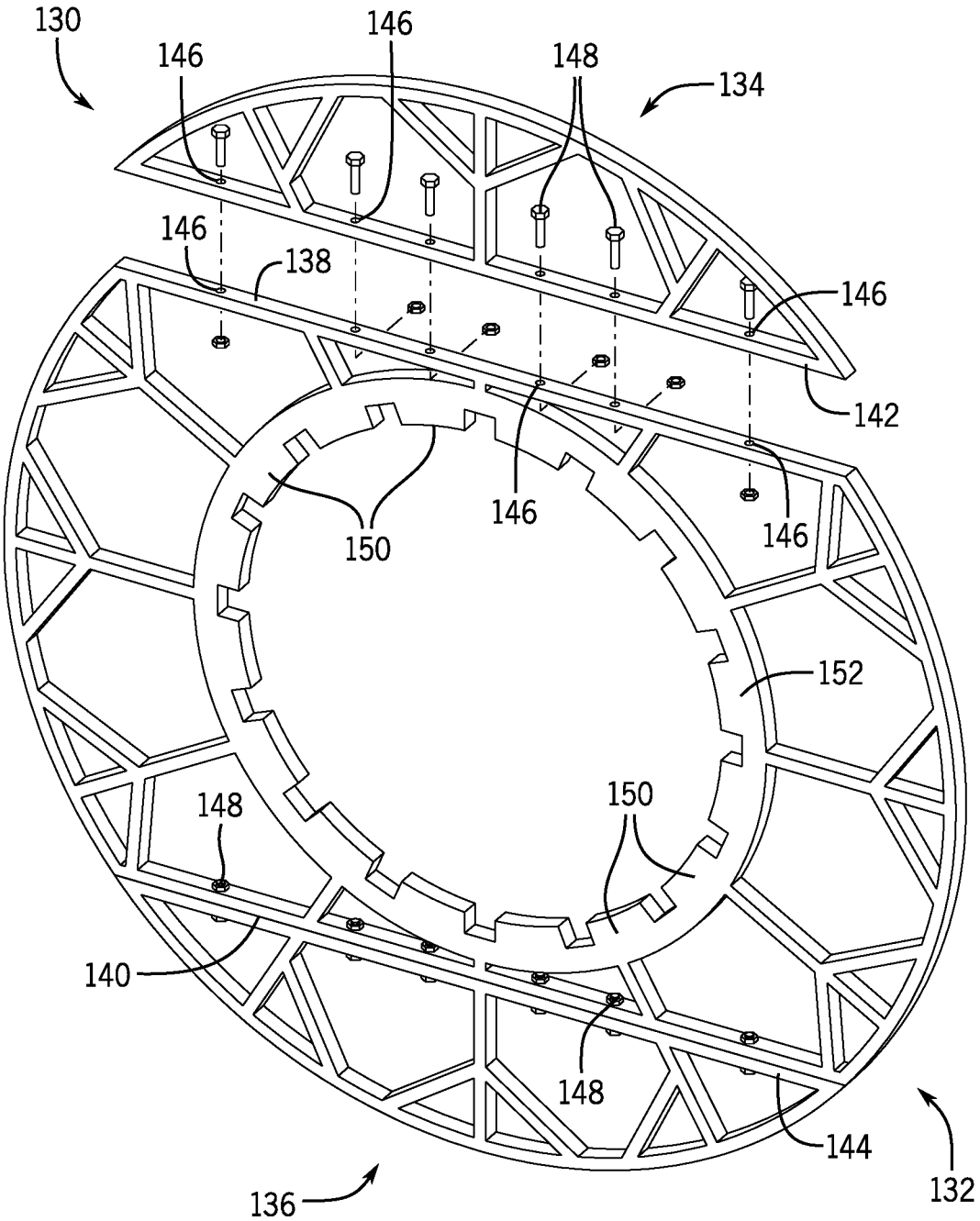
FIG. 4 is a perspective view of a modular flange, according to embodiments of the present disclosure.

FIG. 4 is a perspective view of a modular flange 130. The modular flange 130 includes a central section 132 and wing sections 134, 136. The modular flange 130 may facilitate storage and shipment of flanges for use in assembling reel systems, such as reel systems 12 and 90 described above. The modular flange 130 is assembled by coupling the wing sections 134 and 136 to opposing surfaces 138 and 140 of the central section 132. In FIG. 4, the opposing surfaces 138 and 140 are flat surfaces, but it should be understood that the opposing surfaces 138 and 140 may have a different profile or contour (e.g., wave). These surfaces 138 and 140 are configured to mate with corresponding surfaces 142, 144 on the wing sections 134 and 136. In some embodiments, the surfaces 138, 140, 142, and 144 include apertures 146 that receive bolts 148 that couple the wing sections 134, 136 to the central section 132. In some embodiments, the central section 132 and wing sections 134, 136 may couple together with mating joints (e.g., dovetail joint).

The modular flange 130 is configured to couple to a drum (e.g., drums 20, 92). In order to couple to a drum, the modular flange 130 includes protrusions 150 (e.g., teeth) arranged in a pattern (e.g., repeating and/or non-repeating) that corresponds to a pattern of teeth on the drum. As illustrated, the protrusions 150 extend radially inward from a cylinder 152 of the central section 132. The modular flange 150 may enable assembly and coupling of a reel system to a coil without lifting the coil. Once assembled, the reel system and coil may be set in a cradel for deployment.

Figure 5:
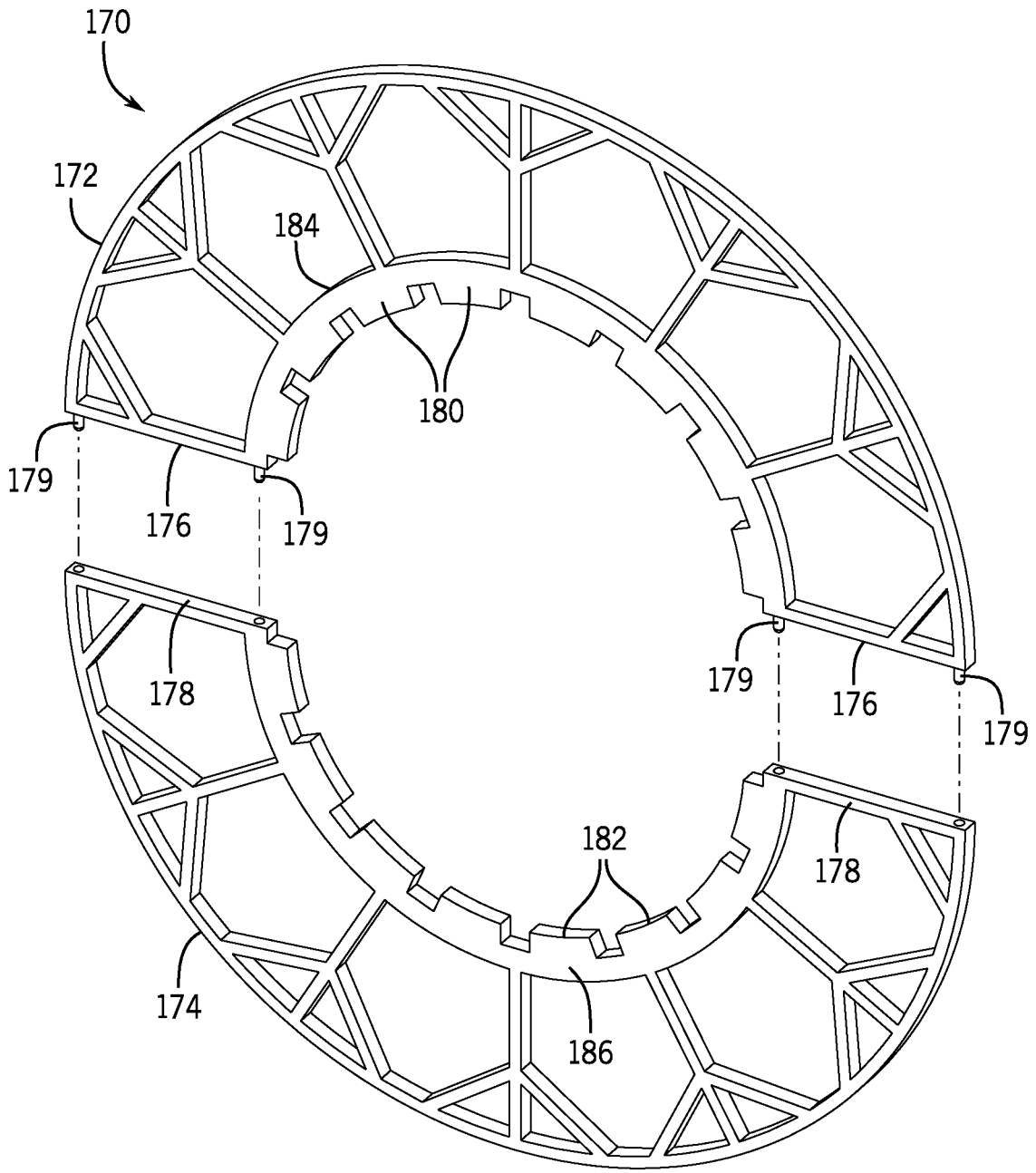
FIG. 5 is a perspective view of a modular flange, according to embodiments of the present disclosure.

FIG. 5 is a perspective view of a modular flange 170. The modular flange 170 includes two sections 172 and 174 (e.g., semi-circular sections) that mate together to form the modular flange 170. In some embodiments, the two sections 172 and 174 may be equally sized (e.g., half-moon shape). In other embodiments, the two sections 172 and 174 may not be equal. As illustrated, the two sections 172 and 174 define respective mating surfaces 176 and 178. These mating surfaces 176 and 178 are configured to align enabling fasteners 179 (e.g., bolts, pins) to couple the two sections 172 and 174 together. In FIG. 5, the mating surfaces 176 and 178 are flat surfaces, but it should be understood that the mating surfaces 176 and 178 may have a different profile or contour. When assembled, the modular flange 170 forms a circular profile. However, it should be understood that the profile may have another shape, such as rectangular.

The modular flange 170 is configured to couple to a drum (e.g., drums 20, 92). In order to couple to a drum, the sections 172 and 174 include respective protrusions 180, 182 (e.g., teeth) arranged in a pattern (e.g., repeating and/or non-repeating) that corresponds to a pattern of teeth on the drum. As illustrated, the protrusions 180, 182 extend radially outward from respective semi-circular surfaces 184, 186. When the sections 172 and 174 couple together, the semi-circular surfaces 184, 186 form a circular profile that receives an end of a drum.

Figure 6:
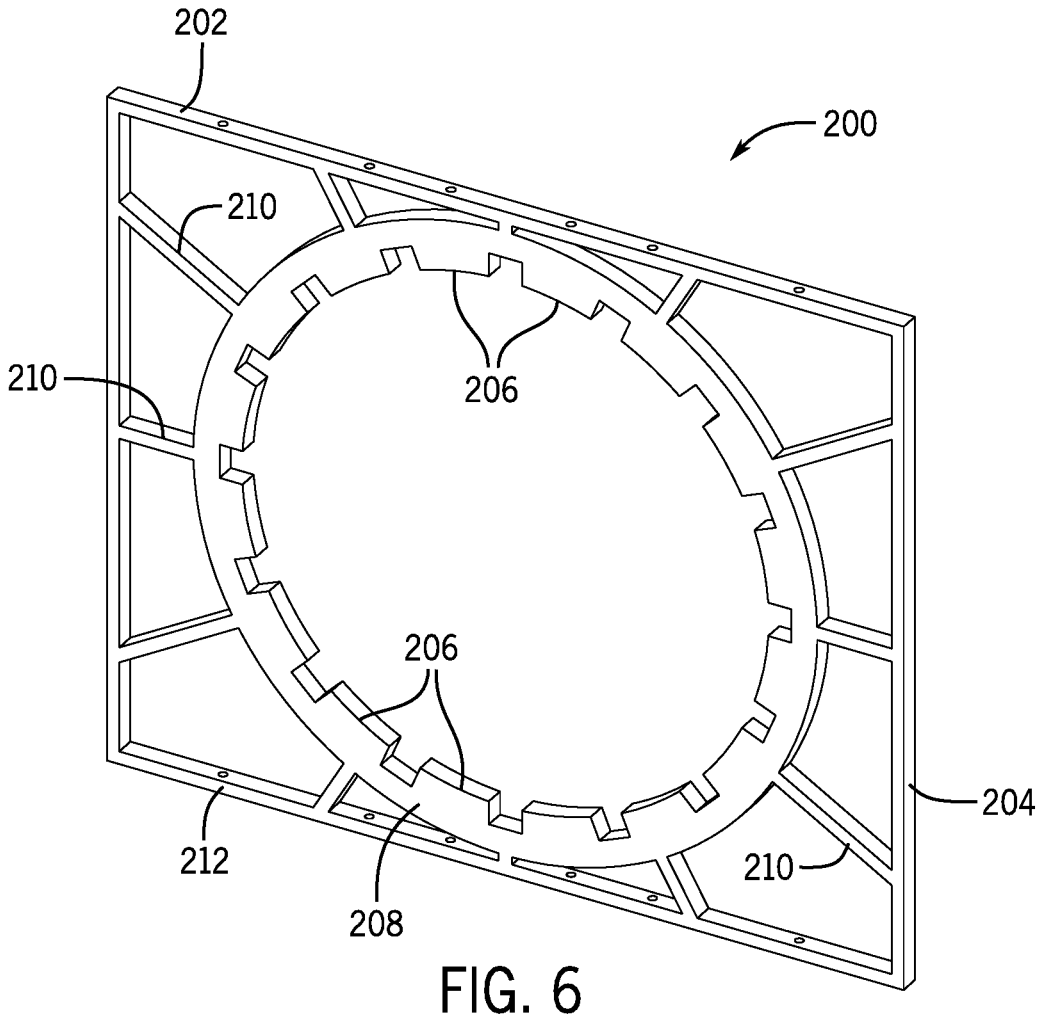
FIG. 6 is a perspective view of a flange, according to embodiments of the present disclosure.

FIG. 6 is a perspective view of a flange 200 that forms part of a reel system (e.g., reel system 12, 90). As illustrated, the flange 200 may not be circular. The non-circular shape (e.g., rectangular) may define a length 202 and height 204 wherein the length 202 is greater than the height 204. By making the height 204 less than the length 202, the flange 200 may enable assembly of a flex system (e.g., 12, 90) without lifting the coil 14. In some situations, the central axis of an aperture through a coil of flexible pipe may not be sufficiently spaced from the ground to enable attachment of a flange (e.g., round flange) to a drum. In other words, the flange may define a height that blocks alignment of the flange with the drum placed in the aperture of the coil. By making the height 204 of the flange 200 less than the length 202 of the flange 200, the flange 200 may be aligned with and coupled to the drum without lifting the coil and drum. Furthermore, the length 202 may be sufficiently long to extend beyond the outermost diameter of a coil to block lateral removal of the coil from the drum.

In order for the flange 200 to couple to a drum, the flange 200 may include teeth 206 that interface (e.g., interlock) with corresponding teeth on the drum. It should be understood, that the pattern of the teeth 206 matches the pattern of the bars 30 on the drum to enable the flange 200 to slide over the exterior surface of the drum. As illustrated, the teeth 206 extend radially inward from an interior cylinder 208. Coupled to the interior cylinder 208 are spokes or bars 210 that couple the interior cylinder 208 to an outer frame 212.

Figure 7:
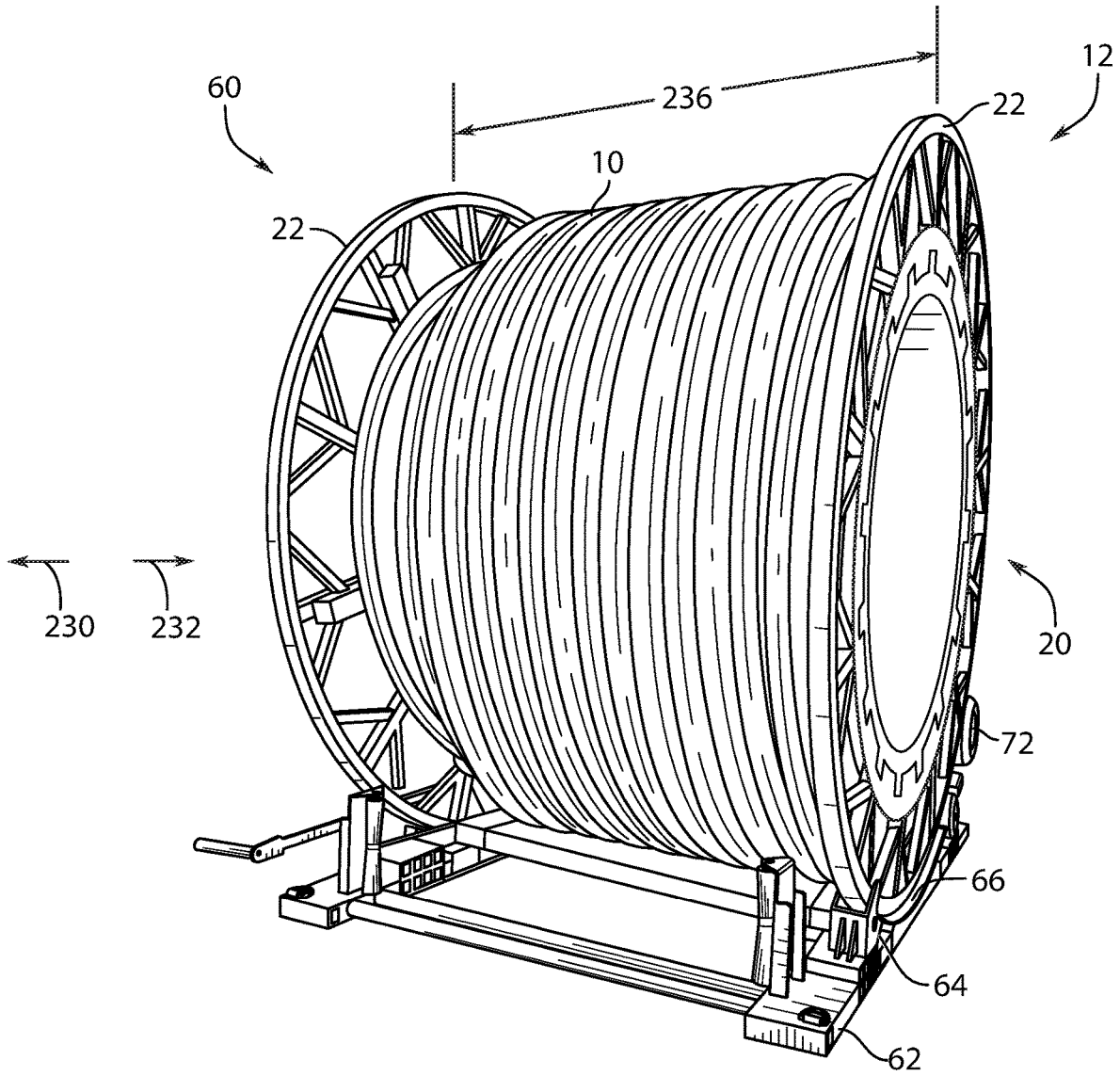
FIG. 7 is a perspective view of a pipe reel cradle supporting a reel system with a coil of flexible pipe, according to embodiments of the present disclosure.

FIG. 7 is a perspective side view of the pipe reel cradle 60 with the reel system 12. In some situations as the flexible pipe 10 unwinds from the reel system 12, the flexible pipe 10 may move laterally in directions 230, 232. To block or reduce lateral movement of the flexible pipe 10, the reel system 12 may include a flange spacing system. The flange spacing system couples to the flanges 22 and reduces the spacing 236 between the flanges 22 to block or reduce lateral movement of the flexible pipe 10 during deployment. In other words, the flange spacing system may pull the flanges 22 closer together to block lateral movement or shifting of the flexible pipe 10 on the reel system 12 as described in more detail in FIGS. 8-10.

Figure 8:
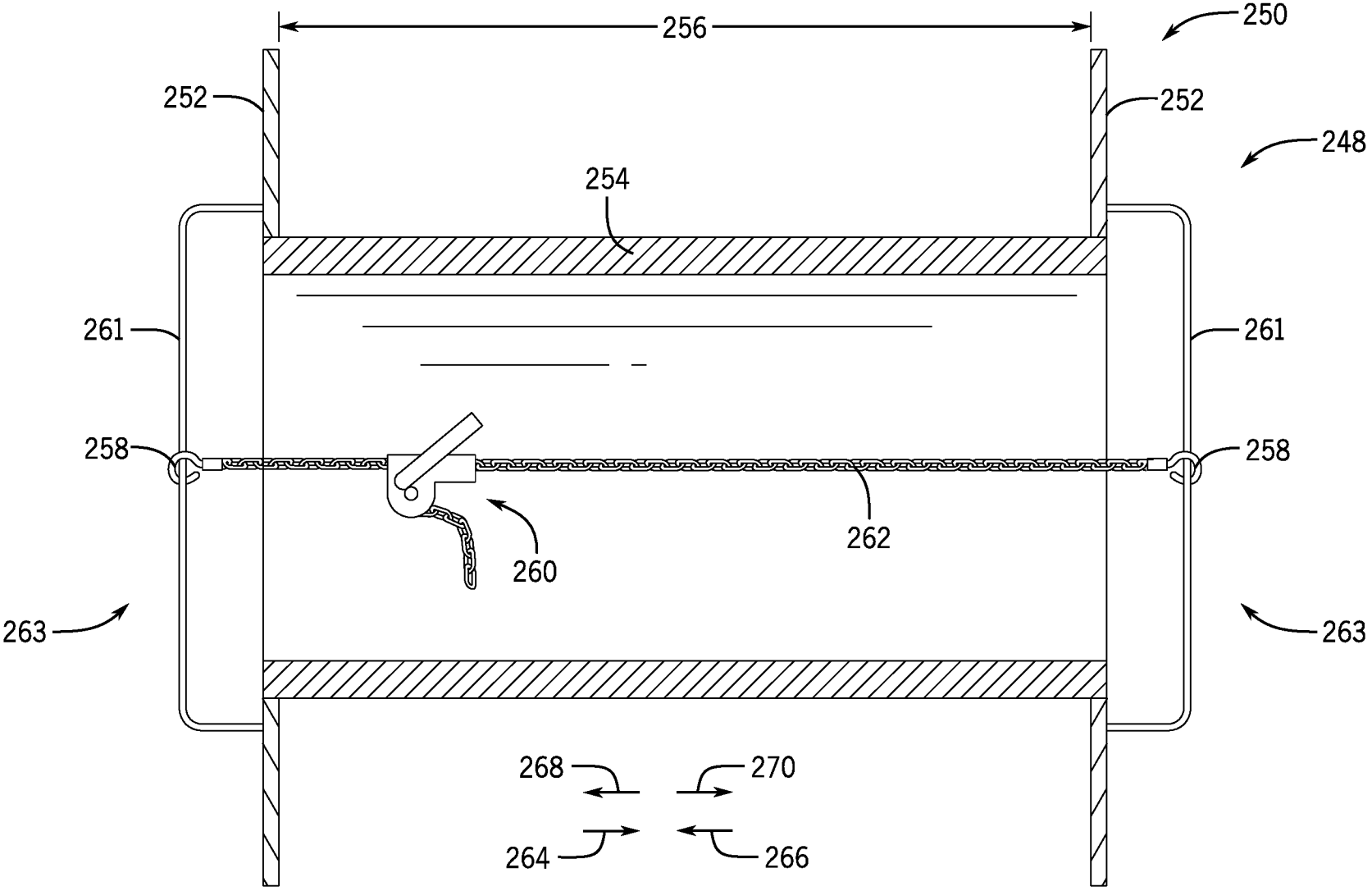
FIG. 8 is a cross-sectional view of a reel system with a flange spacing system, according to embodiments of the present disclosure.

FIG. 8 is a cross-sectional view of a reel system 248 with a flange spacing system 250. The reel system 248 includes flanges 252 that removably couple to a drum 254 that supports a coil of flexible pipe (not shown in FIG. 8). In some situations, a coil of flexible pipe may not extend along an entire distance 256 of the drum 254 either during deployment of the flexible pipe or if the original coil came in a dimension that occupies less than the distance 256. To block or reduce lateral shifting of the flexible pipe on the drum 254, the flange spacing system 250 reduces the distance 256 between the flanges 252. The flange spacing system 250 may include connectors 258 (e.g., hooks). The connectors 258 couple to the flanges 252 and to a ratchet 260 with one or more chains or straps 262. For example, the flanges 252 may include bars 261 that extend over the aperture 263 in the flanges 252. In operation, the bars 261 enable the flange spacing system 250 to couple to the flanges 252.

In operation, the ratchet 260 is adjusted (e.g., manually, automatically) to reduce the length of the chain 262 between the ratchet 260 and one of the flanges 252. As the length of the chain 262 decreases, the flanges 252 are pulled closer together in directions 264 and 266, which may secure the flexible pipe between the flanges 252 and block or reduce lateral movement of the flexible pipe in directions 268 and 270.

Figure 9:
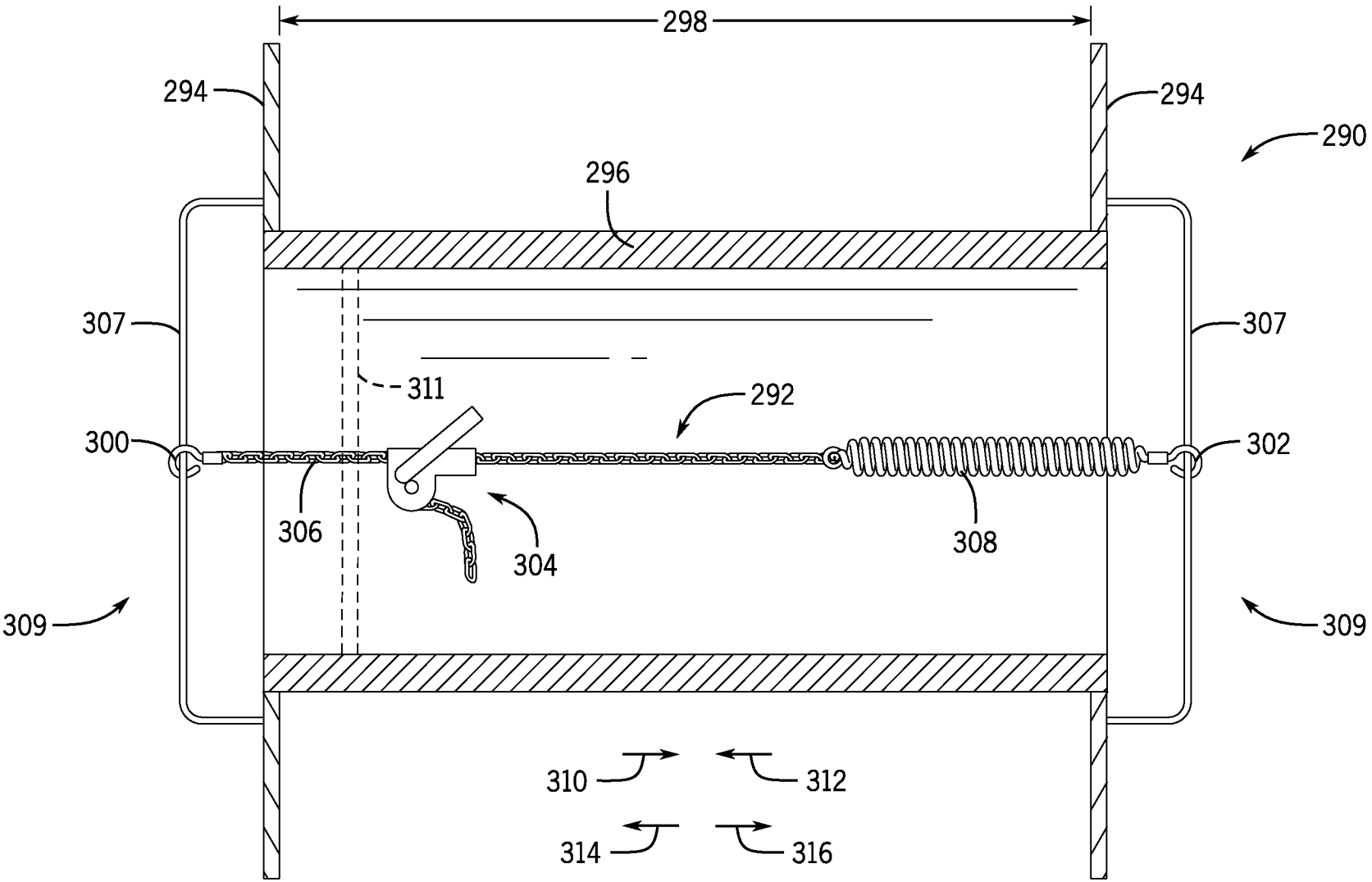
FIG. 9 is a cross-sectional view of a reel system with a flange spacing system that includes a bar, according to embodiments of the present disclosure.

FIG. 9 is a cross-sectional view of a reel system 290 with a flange spacing system 292. The reel system 290 includes flanges 294 that removably couple to a drum 296 that supports a coil of flexible pipe (not shown in FIG. 9). In some situations, a coil of flexible pipe may not extend along an entire distance 298 of the drum 296 either during deployment of the flexible pipe or if the original coil occupies less than the distance 298. To block or reduce lateral shifting of the flexible pipe on the drum 296, the flange spacing system 292 reduces the distance 298 between the flanges 294 in order to compress the flanges 294 against the coil of flexible pipe. The flange spacing system 292 may include connectors 300, 302 (e.g., hooks). The connectors 300, 302 couple to the flanges 294 and to a ratchet 304. Specifically, the connector 300 couples to the ratchet 304 with a chain or strap 306, while the connector 302 couples to the ratchet 304 with a spring 308. For example, the flanges 294 may include bars 307 that extend over the aperture 309 in the flanges 294. In operation, the bars 307 enable the flange spacing system 292 to couple to the flanges 294. In some embodiments, the flange spacing system 292 may couple to a single flange 294. For example, the ratchet 304 may couple to a bar 311 within the drum 296 with the chain 306 instead of coupling to the other flange 294.

In operation, the ratchet 304 is adjusted (e.g., manually, automatically) to reduce the length of the chain 306 between the ratchet 304 and one of the flanges 294. As the length of the chain 306 decreases, the flange spacing system 292 stretches the spring 308. In response, the force of the spring 308 pulls the flanges 294 closer together in directions 310 and 312, which compresses the flanges 294 against the flexible pipe blocking or reducing lateral movement of the flexible pipe in directions 314 and 316.

Figure 10:
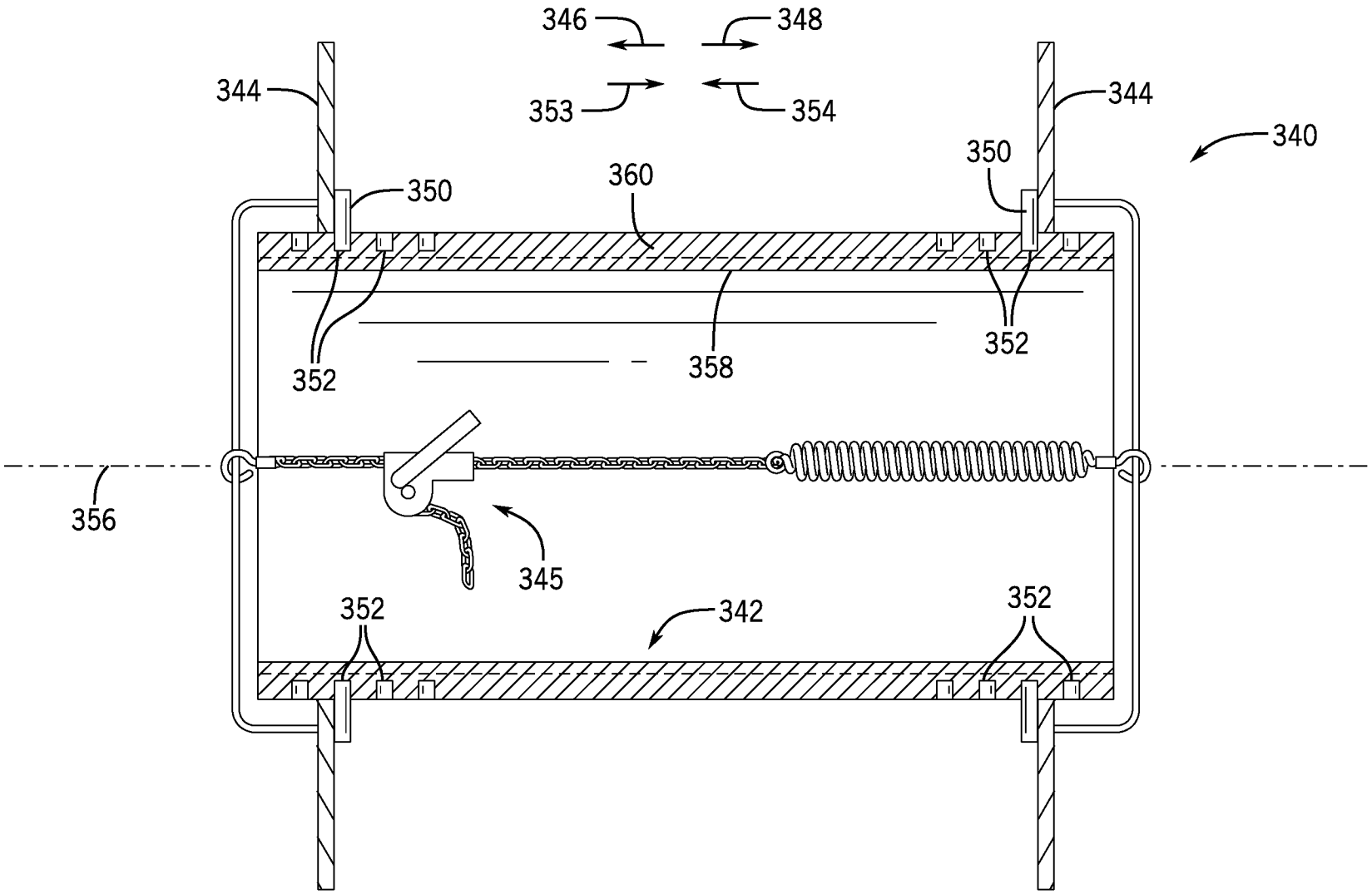
FIG. 10 is a cross-sectional view of a reel system with a flange spacing system that includes fasteners, according to embodiments of the present disclosure.

FIG. 10 is a cross-sectional view of a reel system 340. The reel system 340 includes a drum 342 and flanges 344. In order to couple the flanges 344 to the drum 342, the flanges 344 may slide over the outside of the drum 342. The reel system 340 may also include a flange spacing system 345 that adjusts a distance between the flanges 344 to block or reduce lateral movement of the flexible pipe in directions 346 and 348. In order to block excessive movement of the flanges 344 towards each other, the reel system 340 may include fasteners 350 (e.g., pins, bolts) that couple to apertures 352 on the drum 342. These fasteners 350 may contact the flanges 344 and block excess movement of the flanges 344 in directions 353 and 354 along the axis 356 of the drum 342. As illustrated, the drum 342 may include multiple apertures 352 that extend circumferentially about and axially along the drum 342. It should be understood that these apertures 352 may be in the cylinder 358 and/or in bars 360 that extend along the outer surface of the cylinder 358. As explained above, the bars 360 are configured to engage corresponding protrusions on the flanges 344 to couple the flanges 344 to the drum 342.

Figure 11:
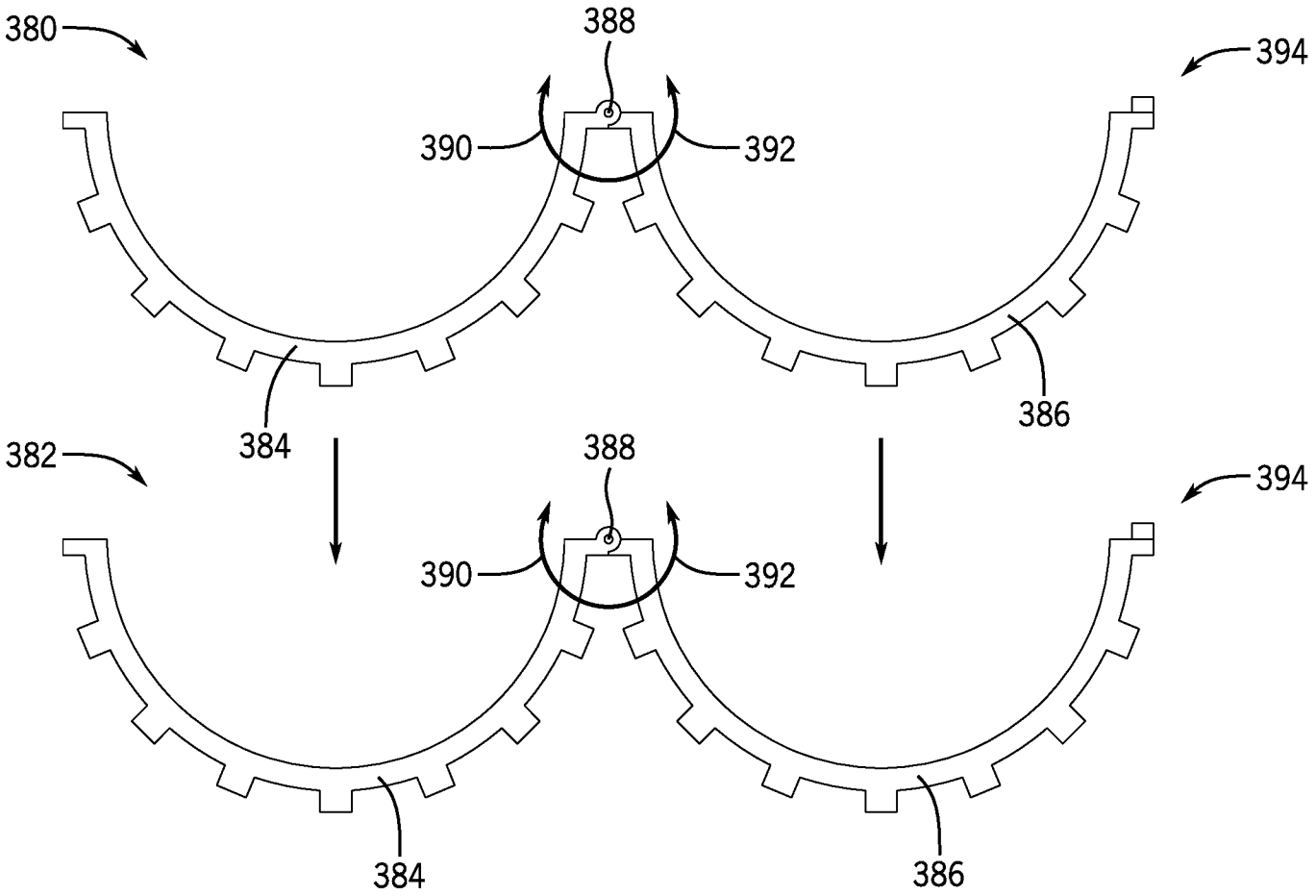
FIG. 11 is a side view of stackable drums, according to embodiments of the present disclosure.

FIG. 11 is a side view of a first split drum 380 and a second split drum 382. The first and second split drums 382 and 384 include similar drum sections 384 and 386 (e.g., semi-circular sections) that couple together with a rotational joint 388. The rotational joint 388 enables the sections 384 and 386 to rotate relative to each other in directions 390 and 392. As the sections 384 and 386 rotate relative to each other, the first and second split drums 382 and 384 transition between a stacking or open configuration and an assembled or closed configuration. In FIG. 11, the first and second split drums 380, 382 are in a stackable or open configuration. That is, the first and second split drums 380, 382 may be stacked on top of each other. The ability to stack the first and second split drums 380, 382 on top of each in the stackable or open configuration may facilitate transport and shipment of the first split drum 380 and the second split drum 382 by reducing the overall amount of space taken. After shipment the first and second split drums 382 and 384 transition from the stacking or open configuration to the assembled or closed configuration in preparation for coupling to a coil of flexible pipe. In order to secure the sections 384 and 386 to each other in the assembled configuration, the first and second split drums 382 and 384 may be fastened together with fasteners (e.g., bolts) and/or with a latch 394.

Figure 12:
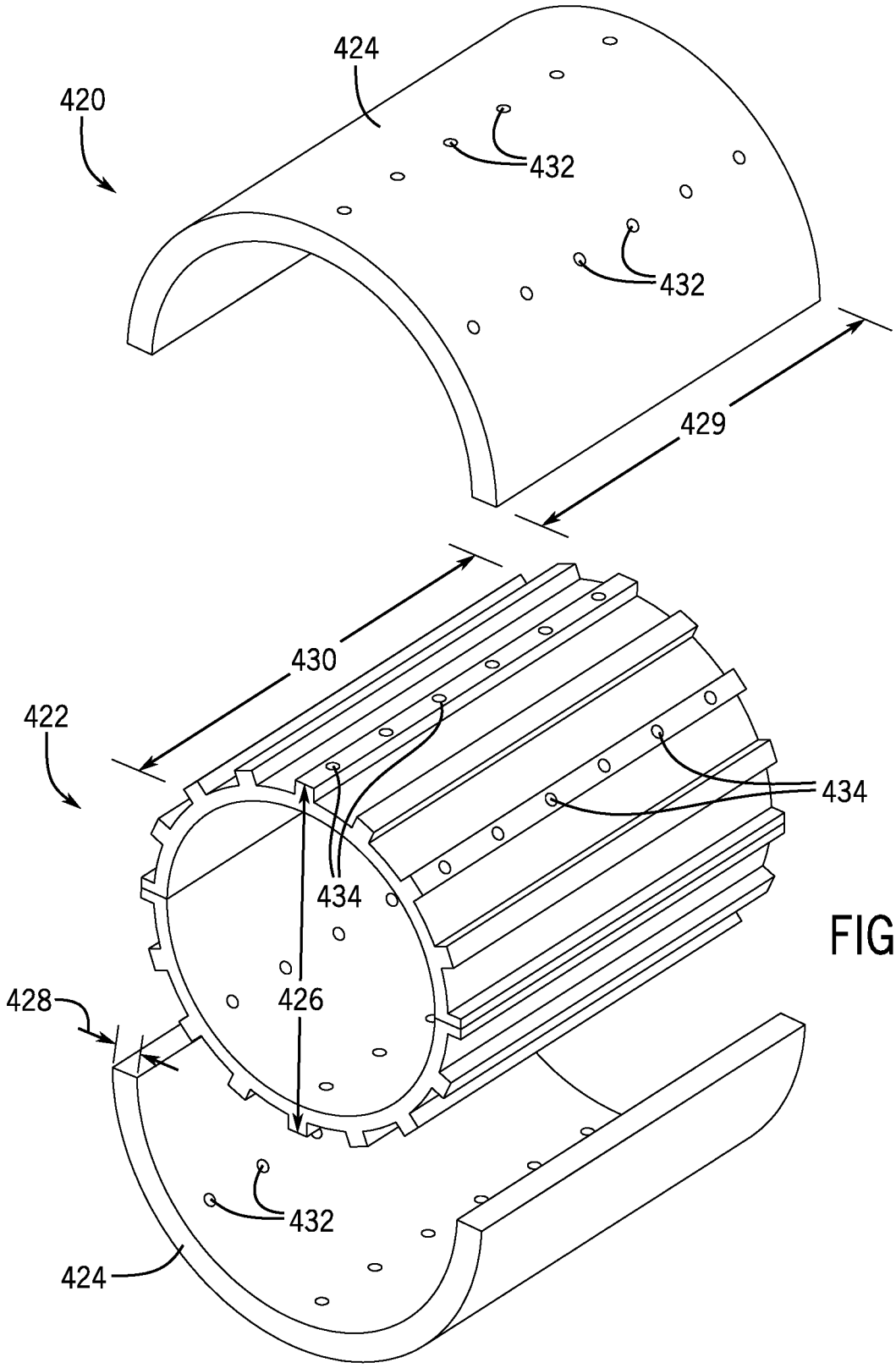
FIG. 12 is a perspective view of a drum modification system, according to embodiments of the present disclosure.

FIG. 12 is a perspective view of a drum modification system 420. The drum modification system includes a drum 422 and shells 424. The drum modification system 420 may be part of a reel system (e.g., reel system 12) that couples to and supports a coil of flexible pipe. Coils of flexible pipe may vary in their innermost diameters depending on the size of the flexible pipe. For example, small diameter flexible pipe may be bound into tight bundles of coil without kinking the flexible pipe. In contrast, large diameter flexible pipe may not be bound into tight coils without kinking. Accordingly, the shells 424 may be added or removed from the drum 422 to accommodate the innermost diameter defined by the coil of flexible pipe. The shells 424 increase the outermost diameter 426 of the drum 422 by the thickness 428 (e.g., width, distance), which corresponds to the thickness of the shell 424 or in the case of a single shell twice the thickness 428. Accordingly, multiple shells 424 may be fabricated each with a different thickness 428 enabling customization of the outermost diameter 426 of the drum 422.

In order to increase the size of the drum 422, one or more shells 424 are coupled to the drum 422. For example, a single shell (e.g., circular shell) may be placed over the drum 422 to increase the diameter. In another embodiment, two semi-circular shells 424 may be coupled to the drum 422. In still another embodiment, a different number of shells 424 may be used (e.g., 1, 2, 3, 4, 5, or more) with each shell 424 extending a fraction (e.g., 10, 20, 30, 40, 50 or more degrees) around the outer circumference of the drum 422. It should also be understood, that the shells 424 may not completely cover the exterior of the drum 422. For example, multiple shells 424 may couple to the drum 422 but with spaces or gaps between the shells 424. In this way, the shells 424 may increase the diameter of the drum 422 without significantly increasing weight.

The shells 424 define a length 429. In some embodiments, the shell length 429 may be less than a drum length 430 in order to accommodate flanges that slide over and couple to the drum 422. In some embodiments, the flanges may slide over and couple to the shells 424. In order to couple to the drum 422, the shells 424 define a plurality of apertures 432 that receive bolts or pins that extend through the shells 424 into apertures 434 in the drum 422. In some embodiments, additional layers (e.g., 1, 2, 3, 4, 5) of shells may couple to the shells 424 to further increase the diameter of the drum 422.

Technical effects of the invention include enabling shipment of and storage of coils of flexible pipe without a reel or spool. The reel system described above enables formation of a reel or spool at a job site or staging site that then receives a coil of flexible pipe enabling deployment of the flexible pipe.

As used herein, the terms "inner" and "outer"; "up" and "down"; "upper" and "lower"; "upward" and "downward"; "above" and "below"; "inward" and "outward"; and other like terms as used herein refer to relative positions to one another and are not intended to denote a particular direction or spatial orientation. The terms "couple," "coupled," "connect," "connection," "connected," "in connection with," and "connecting" refer to "in direct connection with" or "in connection with via one or more intermediate elements or members."

The foregoing description, for purpose of explanation, has been described with reference to specific embodiments. However, the illustrative discussions above are not intended to be exhaustive or to limit the disclosure to the precise forms disclosed. Many modifications and variations are possible in view of the above teachings. Moreover, the order in which the elements of the methods described herein are illustrated and described may be re-arranged, and/or two or more elements may occur simultaneously. The embodiments were chosen and described in order to best explain the principals of the disclosure and its practical applications, to thereby enable others skilled in the art to best utilize the disclosure and various embodiments with various modifications as are suited to the particular use contemplated.

The techniques presented and claimed herein are referenced and applied to material objects and concrete examples of a practical nature that demonstrably improve the present technical field and, as such, are not abstract, intangible or purely theoretical. Further, if any claims appended to the end of this specification contain one or more elements designated as "means for [perform]ing [a function] . . . " or "step for [perform]ing [a function] . . . ", it is intended that such elements are to be interpreted under 35 U.S.C. 112(f). However, for any claims containing elements designated in any other manner, it is intended that such elements are not to be interpreted under 35 U.S.C. 112(f).

What is claimed is:

1. A system comprising a reel system, wherein the reel system comprises:

a drum configured to receive a coil of flexible pipe, wherein the drum comprises:

a first cylinder; and a plurality of bars coupled to an exterior surface of the first cylinder, wherein each of the plurality of bars has a rectangular cross-sectional shape;

a first flange configured to removably couple to a first side of the drum; and a second flange configured to removably couple to a second side of the drum, wherein the second flange comprises:

a second cylinder; and a plurality of teeth that extend radially inward from an interior surface of the second cylinder, wherein the plurality of teeth on the second flange is configured to interlock with the plurality of bars on the drum to facilitate tying rotation of the second flange with rotation of the drum.

2. The system of claim 1, wherein each of the plurality of teeth on the second flange has a rectangular cross-sectional shape.

3. The system of claim 1, wherein the first flange comprises:

a third cylinder; and another plurality of teeth that extend radially inward from an interior surface of the third cylinder, wherein the other plurality of teeth is configured to interlock with the plurality of bars on the drum to facilitate tying rotation of the first flange with rotation of the drum.

4. The system of claim 3, wherein:

the other plurality of teeth extend radially inward from the interior surface of the third cylinder of the first flange to define a first opening through the first flange;

the plurality of teeth extend radially inward from the interior surface of the second cylinder of the second flange to define a second opening through the second flange; and the drum is configured to slide through the first opening in the first flange, the second opening in the second flange, or both to enable distance between the first flange and the second flange on the drum to be adjusted.

5. The system of claim 1, wherein the second flange comprises:

a third cylinder disposed concentrically around the second cylinder; and a plurality of spokes coupled between the second cylinder and the third cylinder to facilitate retaining the coil of flexible pipe on the drum.

6. The system of claim 1, wherein the first cylinder of the drum defines an opening through the drum to facilitate reducing weight of the reel system.

7. The system of claim 1, wherein plurality of bars coupled to the exterior surface of the first cylinder of the drum are configured to provide support strength to the first cylinder that enables the drum to support weight of the coil of flexible pipe.

8. A reel system, comprising:

a drum configured to receive a coil of flexible pipe, wherein the drum comprises:

a first cylinder; and a first plurality of protrusions that extend radially outward from an exterior surface of the first cylinder;

a first flange configured to removably couple to a first side of the drum; and a second flange configured to removably couple to a second side of the drum, wherein the second flange comprises:

a second cylinder; and a second plurality of protrusions that extend radially inward from an interior surface of the second cylinder, wherein:

each of the second plurality of protrusions has a rectangular cross-sectional shape; and the second plurality of protrusions on the second flange is configured to interlock with the first plurality of protrusions on the drum to facilitate tying rotation of the second flange with rotation of the drum.

9. The reel system of claim 8, wherein the first plurality of protrusions on the drum is implemented at least in part by coupling a plurality of bars each having a rectangular cross-sectional shape to the exterior surface of the first cylinder of the drum.

10. The reel system of claim 9, wherein the plurality of bars coupled to the exterior surface of the first cylinder of the drum are configured to provide support strength to the first cylinder that enables the drum to support weight of the coil of flexible pipe.

11. The reel system of claim 8, wherein the first flange comprises:

a third cylinder; and a third plurality of protrusions that extend radially inward from an interior surface of the third cylinder, wherein:

each of the third plurality of protrusions has a rectangular cross-sectional shape; and the third plurality of protrusions on the first flange is configured to interlock with the first plurality of protrusions on the drum to facilitate tying rotation of the first drum flange with rotation of the drum.

12. The reel system of claim 11, wherein:

the third plurality of protrusions on the first flange extend radially inward from the interior surface of the third cylinder of the first flange to define a first opening through the first flange;

the second plurality of protrusions on the second flange extend radially inward from the interior surface of the second cylinder of the second flange to define a second opening through the second flange; and the drum is configured to slide through the first opening in the first flange, the second opening in the second flange, or both to enable distance between the first flange and the second flange on the drum to be adjusted.

13. The reel system of claim 8, wherein the first cylinder of the drum defines an opening through the drum to facilitate reducing weight of the reel system.

14. A reel system comprising:

a drum configured to receive a coil of flexible pipe, wherein the drum comprises a plurality of protrusions that extend radially outward;

a first flange configured to removably couple to a first side of the drum; and a second flange configured to removably couple to a second side of the drum, wherein the second flange comprises:

an interior cylinder;

a plurality of teeth that extend radially inward from an interior surface of the interior cylinder, wherein the plurality of teeth on the second flange is configured to interlock with the plurality of protrusions on the drum to facilitate tying rotation of the second flange with rotation of the drum;

an outer cylinder disposed concentrically around the interior cylinder; and a plurality of spokes coupled between the interior cylinder and the outer cylinder to facilitate retaining the coil of flexible pipe on the drum.

15. The reel system of claim 14, wherein the first flange comprises:

another interior cylinder;

another plurality of teeth that extend radially inward from an interior surface of the other interior cylinder, wherein the other plurality of teeth on the first flange is configured to interlock with the plurality of protrusions on the drum to facilitate tying rotation of the first flange with rotation of the drum;

another outer cylinder disposed concentrically around the other interior cylinder; and another plurality of spokes coupled between the other interior cylinder and the other outer cylinder to facilitate retaining the coil of flexible pipe on the drum.

16. The reel system of claim 15, wherein:

the other plurality of teeth on the first flange extend radially inward from the interior surface of the other interior cylinder to define a first opening through the first flange;

the plurality of teeth on the second flange extend radially inward from the interior surface of the interior cylinder to define a second opening through the second flange; and the drum is configured to slide through the first opening in the first flange, the second opening in the second flange, or both to enable distance between the first flange and the second flange on the drum to be adjusted.

17. The reel system of claim 14, wherein:

each of the plurality of protrusions on the drum has a rectangular cross-sectional shape; and each of plurality of teeth on the second flange has a rectangular cross-sectional shape.

18. The reel system of claim 14, wherein the drum comprises:

a drum cylinder; and a plurality of bars coupled to an exterior surface of the drum cylinder to implement the plurality of protrusions on the drum.

19. The reel system of claim 18, wherein the drum cylinder defines an opening through the drum to facilitate reducing weight of the reel system.

20. The reel system of claim 18, wherein the plurality of bars coupled to the exterior surface of the drum cylinder are configured to provide support strength to the drum cylinder that enables the drum to support weight of the coil of flexible pipe.

* * * * *